US007930893B2

(12) United States Patent
Coffey

(10) Patent No.: US 7,930,893 B2
(45) Date of Patent: Apr. 26, 2011

(54) AUTOMATED ICE TRANSPORT DEVICE AND METHOD

(75) Inventor: Jimmie L. Coffey, St. Charles, IL (US)

(73) Assignee: Restaurant Technology, Inc., Oak Brook, IL (US)

( * ) Notice: Subject to any disclaimer, the term of this patent is extended or adjusted under 35 U.S.C. 154(b) by 683 days.

(21) Appl. No.: 11/799,158

(22) Filed: May 1, 2007

(65) Prior Publication Data

US 2008/0271469 A1 Nov. 6, 2008

(51) Int. Cl.

| | |
|---|---|
| ***F25C 5/00*** | (2006.01) |
| *F25C 5/16* | (2006.01) |
| *F25C 5/18* | (2006.01) |
| *B65D 43/00* | (2006.01) |

(52) U.S. Cl. ..... 62/137; 62/344; 220/827

(58) Field of Classification Search ..... 62/344, 62/137; 366/299; 220/827, 828, 830, 254.5
See application file for complete search history.

(56) References Cited

U.S. PATENT DOCUMENTS

| | | | | | |
|---|---|---|---|---|---|
| 1,475,567 | A * | 11/1923 | Dall | 206/250 |
| 2,287,404 | A * | 6/1942 | Zerk | 62/244 |
| 2,503,031 | A * | 4/1950 | Davidson | 220/825 |
| 2,615,309 | A * | 10/1952 | De More | 62/380 |
| 3,877,241 | A * | 4/1975 | Wade | 62/137 |
| 4,099,642 | A * | 7/1978 | Nergard | 220/715 |
| 4,552,220 | A | 11/1985 | Jones | |
| 4,773,807 | A * | 9/1988 | Kroll et al. | 414/282 |
| 5,546,705 | A * | 8/1996 | Hirtsiefer | 49/386 |
| 5,816,443 | A * | 10/1998 | Bustos | 221/211 |
| 6,779,486 | B2 | 8/2004 | Vaags | |
| 6,932,124 | B2 | 8/2005 | Dalton et al. | |
| 6,953,132 | B2 | 10/2005 | McCann et al. | |
| 7,104,291 | B2 | 9/2006 | Dalton et al. | |
| 7,267,503 | B1 * | 9/2007 | Bentsen et al. | 401/123 |
| 7,739,879 | B2 * | 6/2010 | Sellers et al. | 62/66 |
| 7,780,046 | B1 * | 8/2010 | Lowe | 222/517 |
| 2002/0127140 | A1 * | 9/2002 | Berge et al. | 422/28 |
| 2002/0197117 | A1 * | 12/2002 | Balko | 406/13 |
| 2003/0221338 | A1 * | 12/2003 | Verseef | 37/266 |
| 2004/0156263 | A1 * | 8/2004 | McCann et al. | 366/299 |
| 2004/0163405 | A1 * | 8/2004 | Jung | 62/344 |
| 2004/0169722 | A1 * | 9/2004 | Pena | 348/14.01 |
| 2008/0283145 | A1 * | 11/2008 | Maxwell | 141/114 |

* cited by examiner

*Primary Examiner* — Judy Swann
*Assistant Examiner* — Alexis K Cox
(74) *Attorney, Agent, or Firm* — Ryndak & Suri LLP

(57) ABSTRACT

An automated ice transport device and method that can service one or more remote locations is provided. When ice is needed, the container is automatically filled, and then is transported mechanically along a predetermined pathway to the ice storage device in need, where the ice is dispensed therefrom. The container is returned to the source of ice following the predetermined pathway, remaining there until ice is needed at a location.

20 Claims, 7 Drawing Sheets

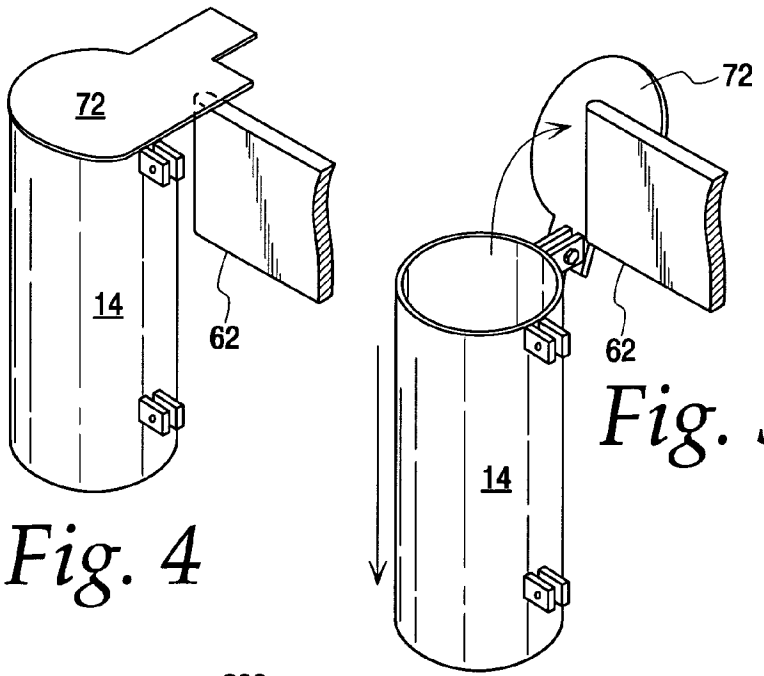
Fig. 4
Fig. 5
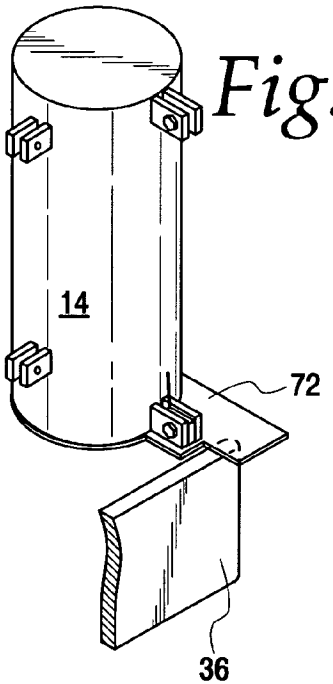
Fig. 6
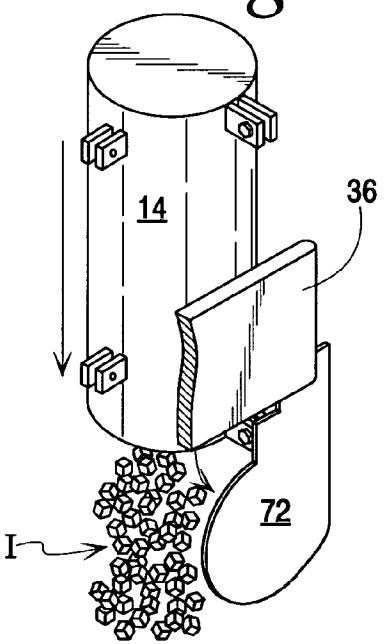
Fig. 7
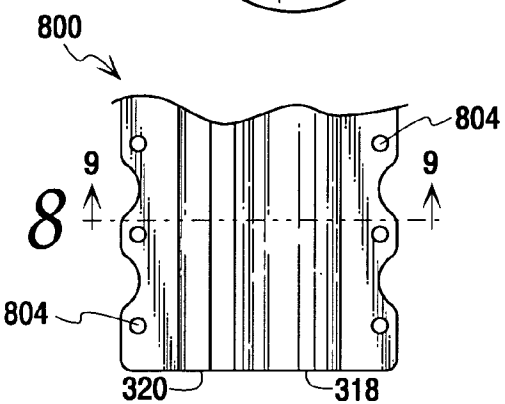
Fig. 9
Fig. 8

AUTOMATED ICE TRANSPORT DEVICE AND METHOD

TECHNICAL FIELD

The present invention relates to the automated transportation of ice for beverages to be dispensed in a restaurant. Specifically, the invention relates to an automated ice transport device and method for ice transport from an ice source to one or more ice storage locations located in a restaurant for subsequent dispensing to restaurant patrons.

BACKGROUND

Restaurants typically serve various types of beverages with ice, typically in the form of ice cubes, crushed ice or flaked ice. Often, a beverage dispensing fountain device will incorporate an ice storage/dispensing device or an ice storage dispenser will be located adjacent the fountain device. Alternatively, the ice may be merely stored in an ice storage bin and ice for beverages can be merely manually scooped therefrom. Typically, the ice is stored and dispensed from, but not made in those types of ice dispenser and storage devices.

The aforementioned equipment may be operated by restaurant employees or by restaurant patrons such as where self-service of beverages is available. The quantity of ice that may be dispensed in such a setting can be substantial over the course of a day.

Ice makers are not typically part of the beverage fountain/ice storage dispenser combination. This is in part because ice makers are expensive, heavy and require space. Thus, the ice contained therein must be periodically replenished. Typically, the ice replenishing is performed manually, such as by a restaurant employee carrying ice in a bucket to the ice storage/dispensing device and dispensing the ice therein.

A need exists for an efficient, reliable, low maintenance, low cost and automated ice transport system and method. A need also exists for such a device and method that can be easily and inexpensively retrofitted to existing restaurants.

In certain known existing ice transportation or delivery systems as disclosed in U.S. Pat. No. 6,167,711, the delivery tube through which the ice is transported may become relatively moist or wet. This can be caused, in part, by some of the ice melting during conveyance or smaller chips of ice breaking off and then subsequently melting. A relatively wet, moist environment potentially can be conducive to the growth of organisms and thus typically is sanitized periodically. The presence of bacteria in the delivery system is not desirable since bacteria may come into contact with ice transported through the system. The tubes also create the possibility of the ice picking up unpleasant flavors if residual sanitizing agents are still in the lines. Consequently, a need also exists for an effective method of transporting ice that eliminates the long delivery tubes and allows the transportation device to be easily sanitized. There is also a need for an ice transport device that can be more effectively rinsed of cleaning agents in order to reduce or eliminate flavor variations in the ice.

A practical and efficient ice transport apparatus and method should minimize the time the ice delivery system is shut down for sanitizing, as well as the time required for performing the sanitizing. Shutting down the system is disruptive, inefficient and not otherwise desirable. In accordance with the invention, the container can be removed and replaced with another while it is cleaned, thereby avoiding machine downtime. The container can be cleaned and/or sanitized quickly and easily by a washing machine, a spray device or by hand, for example.

Restaurants or other commercial facilities often have multiple ice dispensers that are far away from the source of the ice (e.g., one in the dining room, one by the drive-thru window, etc.). Hand delivering ice from the ice source is tedious, labor intensive, slow and can be visible to customers in the restaurant. Restaurants can also consume a large quantity of ice in a short period of time, especially during peak periods such as breakfast, lunch and dinner. A need exists for an ice transport apparatus that is hidden from customer view, can service multiple remote locations, and can easily be installed into existing or new restaurants or other facilities. In addition, a need exists for a device and method that can quickly and efficiently distribute ice from a source to one or more locations.

For purposes of the present invention, the term "ice cube" includes all types, sizes and shapes of ice, including cubes of any shape, crushed ice, lumps and flakes. The term "ice cube" is also intended to include crushed ice.

For purposes of the present invention, the term "sanitizing" means the killing of bacteria, and as known to those skilled in the art, does not necessarily require the complete elimination of bacteria.

SUMMARY OF THE INVENTION

In accordance with the present invention, there is provided a method and device suitable for use in a restaurant for transporting ice from a source of ice to one or more remote locations for storage and/or immediate use.

A device in accordance with the invention includes a movable container for containing ice that is adapted to be mechanically transported along a predetermined pathway by a mechanical transport that mechanically transports the container to and from a source of ice and an ice storage device at a location remote from the ice source. The movable container is transported by the mechanical transport along the pathway from the source of ice to the ice storage device. Structure is provided for dispensing ice from the ice source into the container and for automatically discharging ice from the container and into the ice storage device. The ice storage device in accordance with the invention may be a combination ice storage and dispensing device or may be merely an ice storage bin, for example. In either case, the ice storage device and/or dispensing device contains a quantity of ice for subsequent use in, for example, a beverage. The ice storage device may include suitable insulation and/or refrigeration, as desired.

In accordance with another aspect of the invention, the mechanical transport comprises a driven cable or chain that travels along the pathway along which the container is transportable. The mechanical transport is capable of transporting the movable container between a loading location proximate the source of ice to a discharge location proximate the ice storage device. The container in which the ice is transported between the source of ice and the ice storage device can be carried by the mechanical transport by any suitable structure. Preferably, the container is removably attached to the mechanical transport.

The structure for dispensing ice from the ice source to the container may include a chute that communicates with the ice source and the movable container when the container is at the loading location. In still another embodiment of the invention, the structure for dispensing ice from the ice source to the container may include an auger associated with the ice source for moving ice from the ice source to the movable container when the movable container is located at the loading location.

The container may be removed from the apparatus to be cleaned and sanitized. The container may also be replaced by a spare container while it is cleaned in order to minimize downtime.

In accordance with another aspect of the invention, the ice source can automatically fill a transportable container when an ice storage or dispensing device needs ice. The container then automatically travels to the storage device along a predetermined pathway, dispenses the ice, and returns to the ice source, typically via the same pathway. The container remains at the ice source or at some other location until ice is needed at an ice storage device. In another aspect of the invention, the container is removable from the apparatus. The container may be connected by a grip, fastener, bolt, screw, or any other acceptable mechanical connector.

In another aspect of the present invention, the container is attached to a transport mechanism. It is desired that the container be removably attached to facilitate cleaning and/or sanitization of the container. The transport mechanism moves the container along a predetermined pathway. The transport mechanism can include a driven cable or chain, or any other suitable mechanical device to transport a container.

In yet another aspect of the invention, the container may be mounted to a mechanically self-propelled truck that moves along a guide, track, rail, or other pathway or support having the container attached thereto and moving it along the predetermined pathway with ice contained in the container. The self-propelled truck may be powered by an internal battery or receive its power from an outside source, such as an electrified wire, rail or the pathway it moves along. An internal battery may be replaced or charged at the source of ice when it is not in use.

In accordance with another aspect of the invention, the ice may be dispensed from the ice source by any suitable structure, such as by gravity, along a chute, through a trapdoor, by an auger, conveyor, or combination thereof. If a conveyor is employed to dispense ice, it may have surface variations as desired for transporting ice. The conveyor may also include, at the same or different positions or angles: scoops, flat projections, teeth, grips, spikes, or combinations thereof.

In another aspect of the invention, an operation and control system, including appropriate sensors is provided. For example, an ice level sensor may be provided to determine the level of ice in the container as the container is being filled. The ice level sensor senses when the container is filled and provides a signal so that the dispensing of ice into the container is terminated upon reaching a predetermined level or amount of ice in the container. The predetermined level or amount of ice may be set to a level or amount as desired, such as 75%, 90% or 100% full. The operation and control system may include an electronic controller, suitable sensors and electromechanical devices controlled by the controller upon input from a human operator and/or from the sensors.

In one aspect of the invention, an ice level sensor periodically or continuously checks its level of ice and when the ice reaches a predetermined low level in the storage or storage/dispensing or in the ice storage device, the ice level sensor signals the controller that there is a need for ice to be delivered. The predetermined level or amount of ice remaining in the storage container may be set to any suitable level or amount, as desired, such as, for example, 100%, 25%, or 50% full. Any suitable ice level sensor may be used to determine the level of ice remaining in the container or ice storage and/or dispensing device. For example, the level sensor can be an optical sensor, a thermocouple, a tuning fork, a load or weight sensor, a sensor measuring the strain on the side or base of the ice storage device, or combinations thereof. One or more sensors may be used at or in association with each of the ice source, the transportable container, or a combination thereof.

In one aspect of the present invention, the movable container includes a container lid mounted to the container for pivotable movement between open and closed positions. The container lid can be configured to be opened by use of a trip mechanism, thereby permitting discharge of the ice contained in the transportable container and into the ice storage device. The container lid may be spring-biased to urge the lid to the closed position.

In one aspect of the present invention, the container has a lid movable between open and closed positions. In another aspect of the invention, the lid can be automatically opened by contact with a trip mechanism. After dispensing the ice and starting back to the ice source, the container lid is released from the trip mechanism and the container closes. The trip mechanism may be used at the dispensing location and at the ice source when the container is being filled. For example, the trip mechanism can be a lip around the lid that is mechanically forced open by the container pressing the lip against an external object near the dispensing location and/or at the ice source. In one example, a spring or gravity can be used to move the lid back to the closed position after the external object or trip mechanism is no longer pressing against the lip. In another example, the trip mechanism causes a solenoid to operate to open the lid as it approaches the dispensing location, and to close the lid as it leaves.

In yet another embodiment of the present invention, the container lid is automatically opened by the weight of the ice when the container is proximate the dispensing location. After dispensing the ice, the container lid is closed by suitable structure which may be an internal mechanism. The internal mechanism can be a spring that biased the lid to maintain it in a closed position. When the container is inverted, the weight of the ice overcomes the bias of the spring and opens the lid. In the alternative, the spring is still biased to close, but opens under the weight of the ice, so the ice dumps right after the container is inverted. In yet another aspect of the present invention, the container is opened and closed by a solenoid that transfers electric power into mechanical movement that opens or closes the door. This solenoid may be used at the dispensing location and at the ice source when the container is being filled.

In another aspect of the invention, the pathway or at least a substantial horizontal portion of the pathway is located above the restaurant roof, ceiling or dropped ceiling so that the container travels above the ceiling or roof of the restaurant. Such an arrangement reduces use of restaurant space and helps to conceal the transport device.

In accordance with another aspect of the invention, there is provided a method of loading ice from a source of ice into a movable container, moving the container along a pathway to a remote ice storage location, and automatically discharging the ice at the ice storage location. The container may also return along the pathway to the source of ice. Additionally, the amount of ice at the delivery location may be sensed. When the amount goes below a predetermined level, the controller causes the ice delivery system to operate to deposit ice at the delivery location from the source of ice. The predetermined level may be set to any level, such as 0, 25, or 50% full.

BRIEF DESCRIPTION OF THE DRAWINGS

FIGS. 4-5 are perspective views of a portion of the automated ice transport device of FIG. 1 showing operation of a trip mechanism and a transportable container in accordance with the invention opening the container at the loading location;

FIGS. 6-7 are perspective views of a portion of the automated ice transport device of FIG. 1 showing operation of a trip mechanism in accordance with the invention opening the container at the dispensing location;

FIG. 8 is an elevation view of a portion of a cable guide in accordance with the invention;

FIG. 9 is a cross-sectional view along lines 9-9 of FIG. 8;

DETAILED DESCRIPTION OF THE INVENTION

Figure 1:
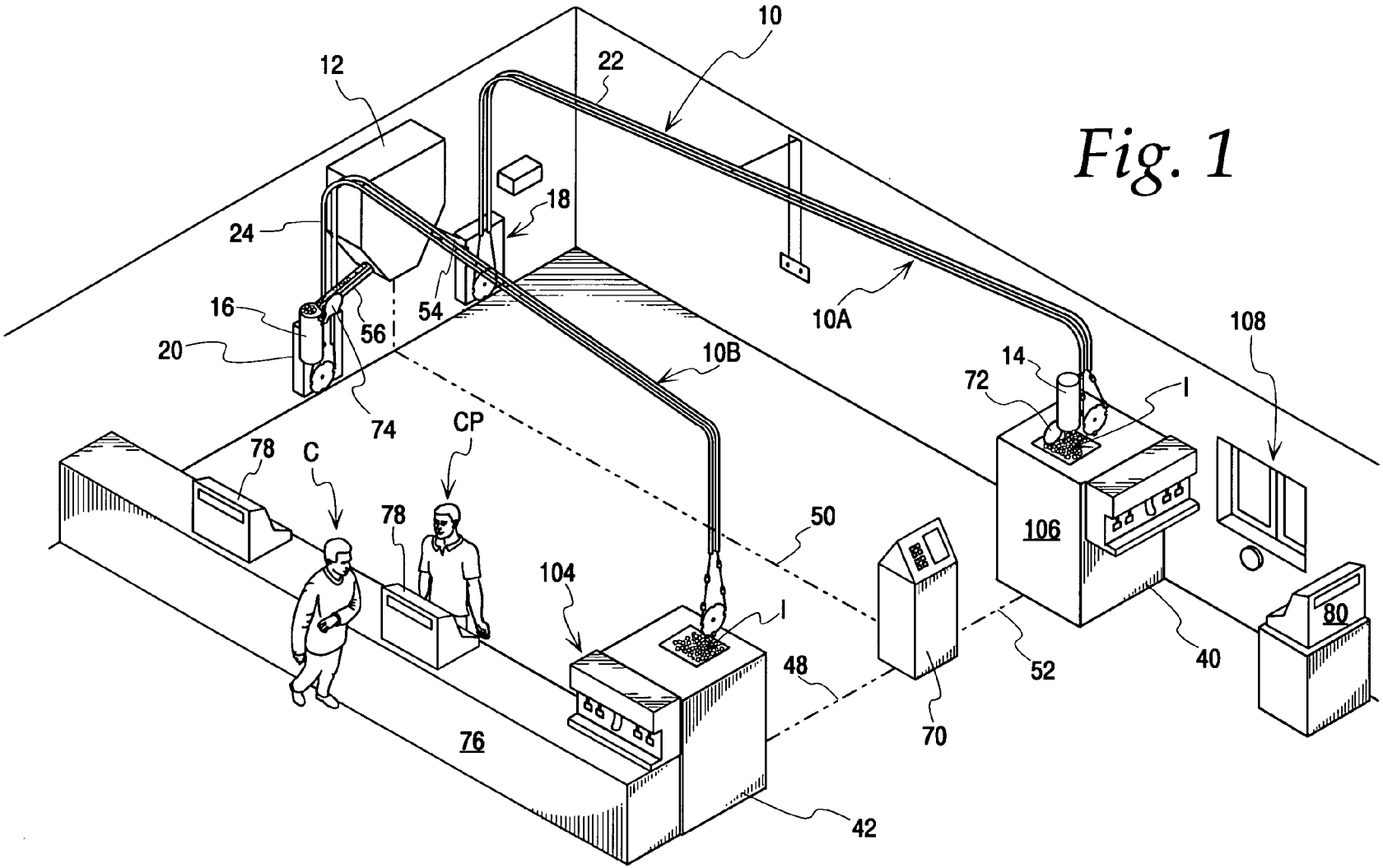
FIG. 1 is a perspective view of an embodiment of the automated ice transport device in accordance with the present invention.
Figure 2:
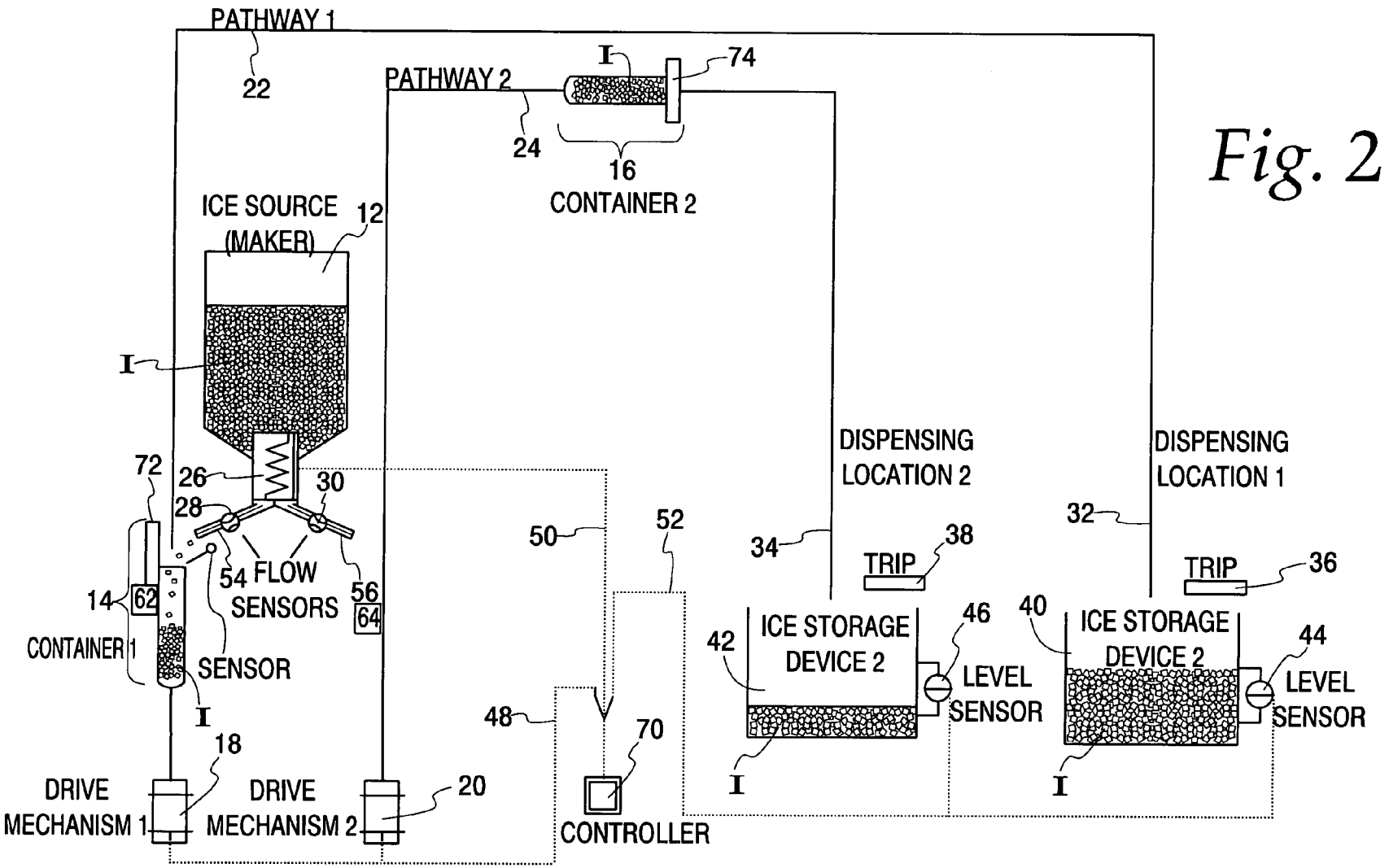
FIG. 2 is a schematic view of the automated ice transport device of FIG. 1, including a control system, in accordance with the invention.

Referring to the figures generally and in particular to FIGS. 1-2, there is illustrated an automated ice transport device 10 in accordance with the invention. As illustrated in this particular embodiment, automated ice transport device 10 is comprised of an ice source 12, and two separate sub-systems that can be operated independently to provide ice at two different locations within a single restaurant. It is to be understood that an automated ice transport device in accordance with the invention can be configured to deliver ice to a single location or to two or more locations, merely by adding additional equipment in accordance with the invention. Automated ice transport device 10 includes transportable containers 14 and 16, respective drive mechanisms 18 and 20 which define predetermined pathways 22 and 24, one pathway for each of containers 14 and 16. Device 10 also includes ice dispensing locations 32 and 34, trip mechanisms 36, 38, 62 and 64, for opening and closing containers 14 and 16, respectively, ice storage devices 40 and 42, a controller 70, and lids 72 and 74 that form part of containers 14 and 16, respectively, and other components, all of which will be described in detail hereafter.

Device 10 is particularly suitable for use in a quick service restaurant where large quantities of ice are needed and where it is desired to convey ice from an ice source (which may be in a remote location, such as a backroom or storeroom, for example) located away from the main serving and production areas to ice storage devices, as desired, in this case ice storage devices 40, 42. Alternatively, for example, ice may be conveyed to several different storage containers, which, as illustrated, are a self-service combination fountain beverage ice dispenser 104 that dispenses ice and various beverages directly to restaurant customers C and by restaurant employees at a combination beverage fountain/ice dispenser 106 located proximate drive-thru window 108. Although illustrated and described herein as transporting ice to two remote locations, ice may be distributed to only one or to as many different locations as are desired. As will be appreciated, the present invention is suitable for distributing ice in any of a variety of environments and layouts. As illustrated in FIG. 1, the restaurant environment depicted includes a point-of-sale counter 76 having several point-of-sale registers 78 thereon which are operated by a crew person CP. In addition, another point-of-sale register 80 is provided at drive-thru window 108.

Ice source 12 may be an ice maker, an ice storage bin, and in this case is a combination ice maker and ice storage bin. Any suitable type of ice making and/or storing apparatus may be used in accordance with the invention. Ice I is dispensed initially from ice source 12 by any suitable mechanism, in this case by an auger 26 for subsequent distribution through chutes 54 and/or 56, which may be tubular, for example, or any other desired configuration. Ice I is dispensed from chutes 54 and/or 56 to containers 14 and/or 16, respectively. Ice I may be dispensed from ice source 12 by any suitable means, for example, gravity, a chute, tube, trapdoor, slide, auger, conveyor, or any combination thereof.

Figure 10A:
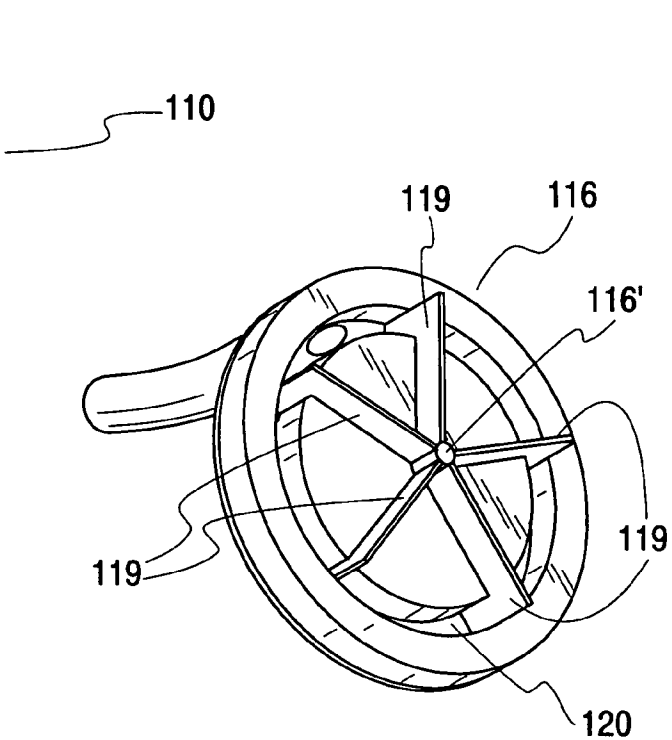
FIG. 10*a* is a perspective view of a dispensing wheel useful with the present invention.
Figure 10:
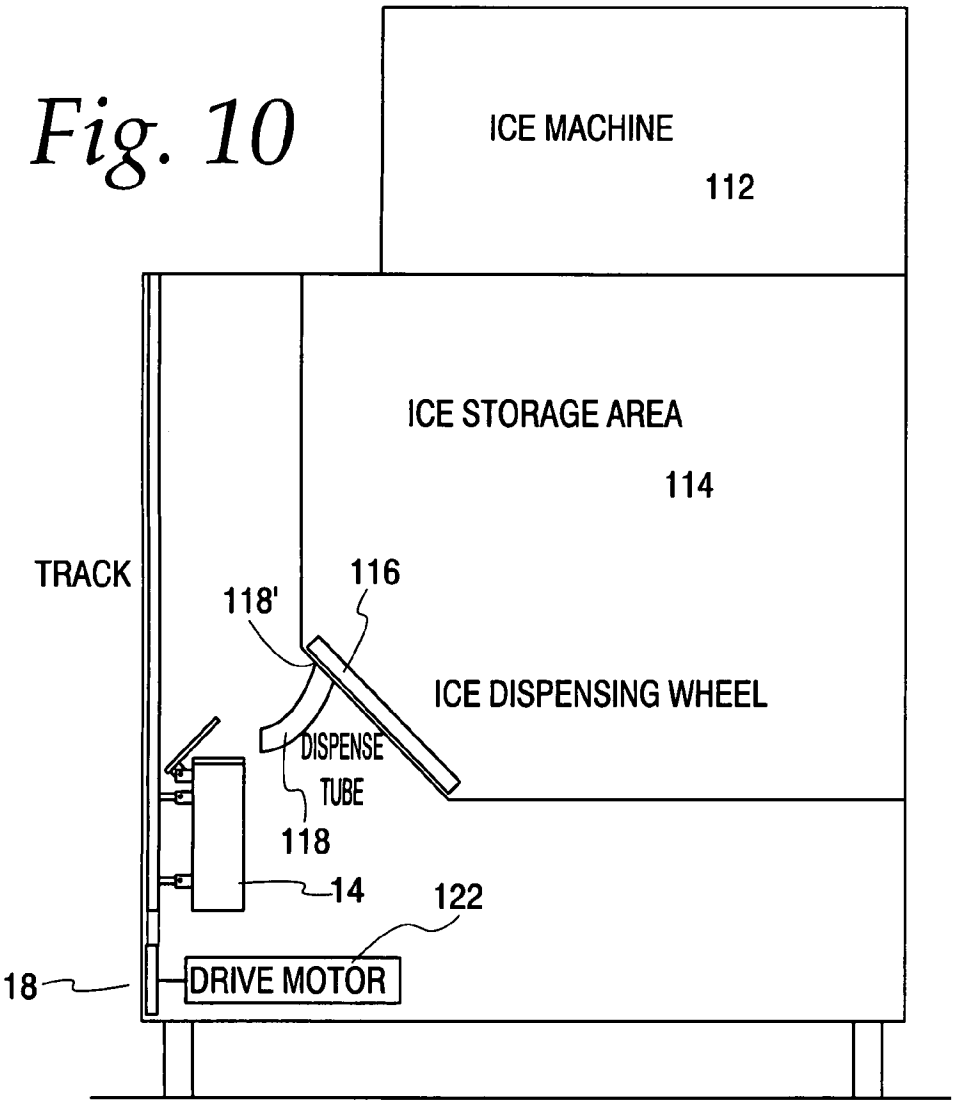
FIG. 10 is a schematic view of an alternative embodiment of an ice maker/dispenser in accordance with the invention.

An alternate arrangement is illustrated in FIG. 10 in which ice maker/dispenser 110 includes an ice maker 112, an ice storage bin 114, an ice dispensing wheel 116 which rotates about its axis 116' to carry ice from ice storage bin 114 to ice dispenser tube 118. Wheel 116 has a plurality of raised radially extending dividers 119 which operate to carry ice in bin 114 up to and into ice dispenser tube 118 where the ice falls through the portion of slot 120 in dispenser wheel 116 that is adjacent the upper end 118' of dispenser tube 118 and into transportable container 14. After transportable container 14 is filled with the desired quantity of ice, it is transported via drive mechanism 18 which includes a drive motor 122 which drives a cable 330, in a guide 318 (shown in FIG. 3). Movement of cable 330 carries container 14 to and from the loading and dispensing locations as described hereafter.

Figure 3:
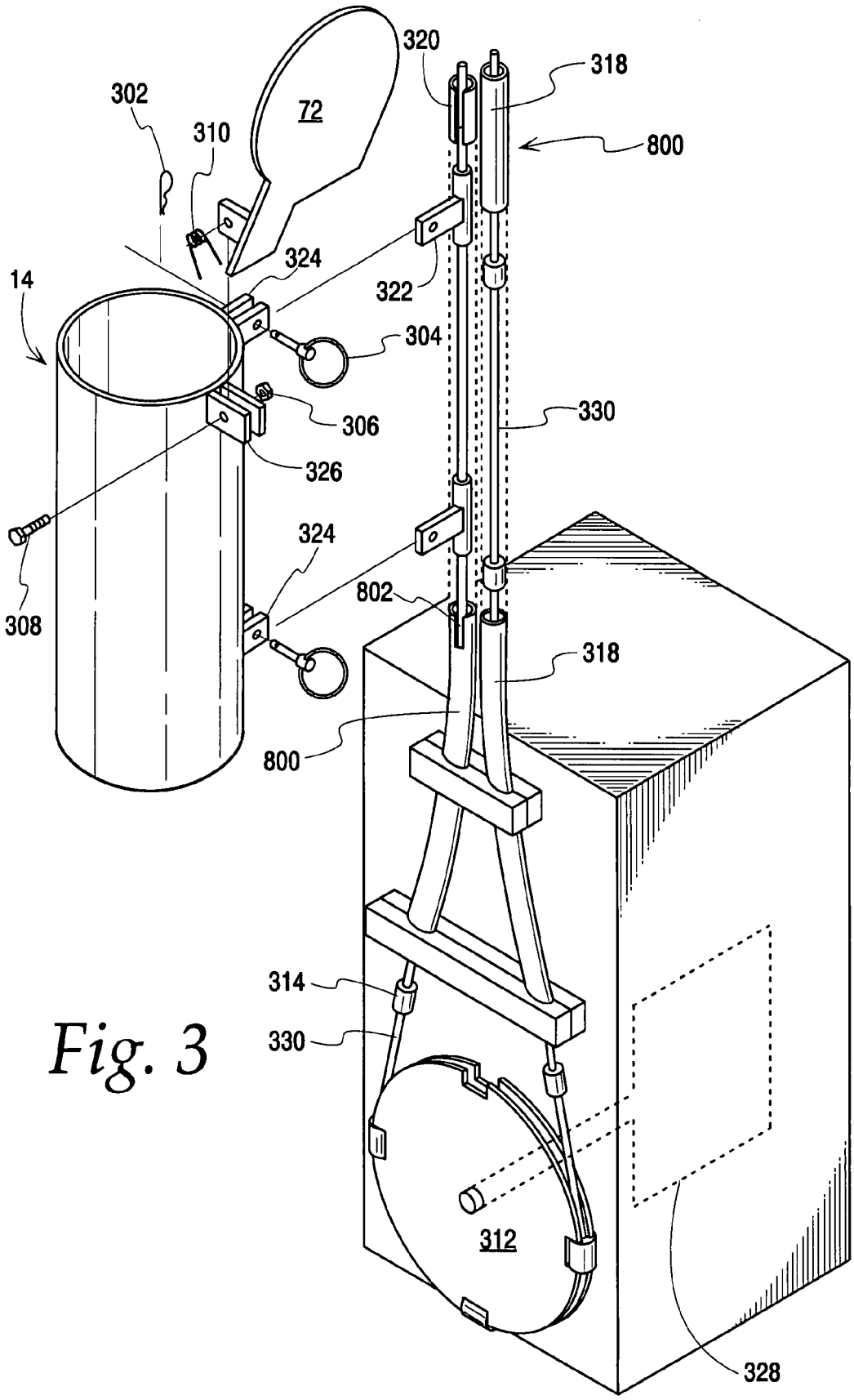
FIG. 3 is a perspective view of a portion of the automated ice transport device of FIG. 1.

Referring to FIGS. 3-7, containers 14 and 16 have pivotable lids 72 and 74 that pivot into the open and closed positions. Any suitable structure for pivotably connecting lids 72 and 74 may be used. Lids 72 and 74 may use a solenoid, spring, elastic band, gravity, trip mechanism, or any other suitable structure for opening and closing lids 72 and 74. In FIG. 3, there is one sample embodiment of the lid 72 being connected to container 14. In the embodiment, a threaded bolt 308 and nut 306 connect the lid mount 326 to a container mount 324.

Lids 72 and 74 may be opened by trip devices 36, 38, 62, and 64, which may be any suitable apparatus that forces lids 72 and 74 open when containers 14 or 16 move against the trip device or mechanism. One example is lids 72 and 74 being opened by stationary trip mechanisms 36, 38, 62, and 64 putting pressure on the edge of lids 72 and 74, thereby forcing their respective lid 72 or 74 open. As illustrated in FIGS. 2, 4 and 5, trip mechanisms 62 and 64 are in a fixed position and may open their respective lid 72 or 74 as containers 14 and 16 approach ice source 12. As illustrated in FIG. 6 and FIG. 7, stationary trip mechanisms 36 and 38 may open their respective lid 72 or 74 as containers 14 and 16 approach dispensing locations 32 and 34 to dispense ice I therefrom and into an ice storage device.

As illustrated in FIG. 3, in another embodiment, spring 310 connects lids 72 and 74 to their respective container 14 or 16. Spring 310 may be biased to close lids 72 and 74 and not open under the weight of ice I when containers 14 and 16 invert. Thus, lids 72 or 74 would have to be opened at dispensing locations 32 or 34 by trip mechanism 36 or 38, respectively. Alternatively, spring 310 can be biased to close lids 72 and 74, but opens under the weight of ice I when containers 14 and 16 are inverted. Thus, lids 72 and 74 would not have to be opened at dispensing locations 32 and 34 by trip mechanism 36 and 38, respectively. Ice I would drop out into ice storage devices 40 or 42 when containers 14 and 16 invert. Spring 310 may also be adapted to close lids 72 and 74 once ice I is dispensed. FIG. 3 illustrates spring 310 as a torsion spring, but any suitable spring can be used.

In another example, a solenoid (not pictured) may be used to open and close lids 72 and 74. Trip mechanisms 36 and 38 cause the solenoid to operate to open lids 72 and 74 as containers 14 and 16 approach the dispensing location, and to close lids 72 and 74 as containers 14 and 16 leave. Alternatively, the solenoid could just be used to open or just be used to close, while the other step is accomplished by some other means, such as a spring or trip mechanism. As previously discussed, containers 14 and 16 may get power from an internal power supply or from the track, rail, or other mechanical means that propel containers 14 and 16.

Before containers 14 and 16 are filled with ice, trip mechanisms 62 and 64 operate to open lids 72 or 74, respectively. After container 14 is filled, container 14 is moved along pathway 22 to dispensing location 32 by drive mechanism 18. After container 16 is filled, container 16 is moved along pathway 24 to dispensing location 34 by drive mechanism 20. When containers 14 and 16 arrive at ice source 12, trip mechanisms 62 and 64 open associated lid 72, 74 of containers 14,16. Ice I is dispensed into ice storage devices 40, 42 by container 14, 16, respectively. Containers 14 and 16 then can be returned to ice source 12 following their respective pathway 22, 24.

Containers 14, 16 are mechanically propelled along their respective pathway 22, 24. Any effective suitable mechanical system of moving containers 14, 16 along their respective pathway 22, 24 may be used. For example, the mechanical system can be a driven cable, chain, or any other structure for mechanically driving containers 14, 16 along their respective pathway 22, 24. Pathways 22, 24 may follow a desired course, which may be located above a ceiling or other area so as to be obscured from view. Any suitable drive mechanisms 18, 20 may be used to move the cable, chain, rope, or other mechanical means of moving containers 14 and 16. For example, the drive mechanism can be a variable speed motor, a single speed motor, or any suitable motor.

FIG. 3 illustrates one embodiment of the mechanical transport mechanism and includes a drive motor 328 which drives a notched pulley gear 312, which, in turn, drives a cable 330 with catches 314. Cable 330 and catches 314 are disposed in a loop and can be of any suitable material or shape. FIG. 8 and FIG. 9 illustrate a fragmentary view of a double channel cable guide 800 for cable 330 to follow. The sample cable guide shows several mounting holes 804 that can be used to secure cable guide 800 in place such as to a wall, ceiling or other supports. Cable 330 connects to the container 14 through slot 802 and moves in the same direction along the pathway 22 as the container. Cable 330 in closed guide 318 is looped around the notched pulley gear 312 and travels in the opposite direction along the pathway 22 of the cable in the slotted guide 320 and the container 14 or 16.

Figure 12:
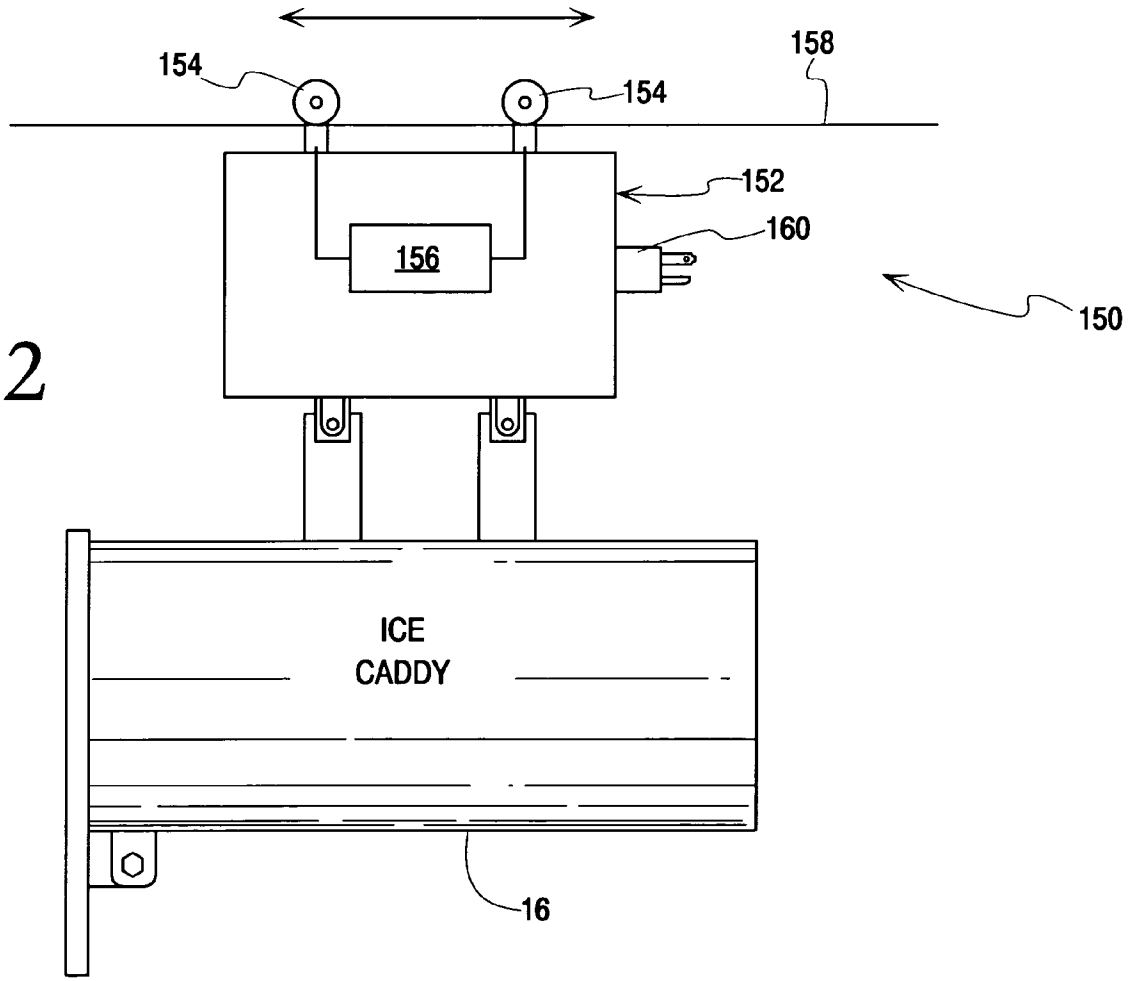
FIG. 12 is a schematic illustration of a motorized truck in accordance with the invention.

Referring to FIG. 12, there is illustrated an alternative mechanical transport device 150 in accordance with the invention. Mechanical transport device 150 is composed of a motorized truck 152 having drive wheels 154 that are driven by a suitable motor 156, which typically would be an electric motor. Truck 152 traverses a suitable guide, which in this case is a track 158 (in lieu of cable 330 and cable guide 318 that extends from the ice source, such as ice source 12 to an ice storage device, such as ice storage device 104 (i.e., pathway 24)). Truck 152 carries the ice container such as container 16, removably attached thereto and operative in a manner described with respect to FIGS. 4-7.

Motorized truck 152 may be powered by a suitable internal power source, a battery, for example, or from electrical power via the rail, track, or whatever mechanical structure is provided along the pathway, such as pathway 24. If an internal battery is used, the battery may be replaced or recharged when the containers are not being used, as when truck 152 is at a home location via receptacle 160 of truck 152.

In another example, containers 14 and 16 could have a second opening (not pictured) opposite of lids 72 and 74. Trip mechanisms 36 and 38 could open the second opening without inverting containers 14 and 16 and close it again as it leaves dispensing locations 32 and 34.

Containers 14 and 16 are preferably removable from device 10 for cleaning and then reattached to device 10. Containers 14 and 16 may be connected to the device 10 by a grip, fastener, nut and bolt, cotter pin, screw, or any other acceptable connector. FIG. 3 illustrates one example of how to connect lid 72 to container 14 with a cotter pin 302 and clevis pin 304. The cotter pin 302 and clevis pin 304 hold together a cable mount 322 and a container mount 324. The cotter pins 302 can be easily removed, allowing the containers 14 and 16 to be taken off for cleaning or repair. In this embodiment, the cable mount 322 and a container mount 324 can be any shape that allows them to fit together and be able to be locked in place by a suitable cotter pin, which may be a spring-type cotter pin 302 and clevis pin 304, as illustrated.

Containers 14 and 16 may be sanitized as often as necessary or desired. Preferably, if there are multiple containers, only one container will be removed and sanitized at a time. Alternatively, spare containers may be on hand to replace the container being cleaned so all containers can be cleaned at once. Containers 14 and 16 may be cleaned by hand, in a washing machine, or in any other suitable manner. Any suitable type of container that allows the ice to be transported and allows the container to be cleaned may be utilized. Alternatively, the containers may be disposable and thus need not be cleaned. Preferably, the container is capable of retaining solids and liquids in a leak-proof or substantially leak-proof manner.

The invention may also include an electronic control system composed of controller 70 and one or more electrically conductive control lines, such as lines 48, 50 and 52 in FIG. 2. Controller 70 uses control lines 48, 50 and 52 to communicate with and regulate various components of device 10. For example, controller 70 could control auger 26, drive mechanisms 18 and 20, and chutes 54 and 56. Controller 70 may be manually or automatically operated. Manual input can be performed by a human operator, for example. Preferably, controller 70 is configured so that when ice source 12 is made to deliver ice I to container 14 or 16, the associated chute 54 or 56 is opened and the other chute is closed.

Ice I may be discharged from ice source 12 by any suitable method, such as by gravity, auger, chute, a conveyor (not shown), or any combination thereof. The conveyor may be flat or have protrusions such as scoops, grips, teeth, spikes, bumps, plates, or combinations thereof. The quantity of ice may be a preselected amount or may be based on a sensor or sensors associated with or in container 14 or 16, such as optical sensors 28 and 30 in FIG. 2. The sensors are appropriately associated with respect to respective containers 14 and 16 to determine the amount of ice discharged thereto and thus may be on or in container 14 or 16, on or in ice source 12, or any combination thereof. The sensor or sensors may determine the amount of ice I by any suitable manner. For example, the sensor could determine the amount based on the height, weight, sound, temperature, pressure, or any combination thereof. Some examples of suitable sensor types are a thermocouple, tuning fork, weight scale, wall pressure measure, and/or an optical sensor.

Ice storage devices 40 and 42 store the ice before it is used, such as in beverages, for example, or for some other purpose as desired. Ice storage devices 40 and 42 are physically removed from ice source 12. Typically, ice storage devices 40 and 42 are insulated and may also be refrigerated. Access to ice storage devices 40 and 42 can be provided by a suitable opening which may have a door (not shown) to cover the opening. The door may have an automated opening and closing device so that the door opens just prior to delivery of ice thereto and closes shortly after delivery of ice thereto from one of containers 14 or 16. Ice storage devices 40 and 42 may be part of or close to beverage dispensers or in locations where a customer may have access to them. Level sensors 44 and 46 are provided to determine the amount of ice in ice storage devices 40 and 42. The sensors as appropriate may be inside or outside the ice storage devices 40 and 42. The level may be determined by temperature, weight, sound, wall pressure, ice height, a combination of these, or any other effective method. Some examples of possible sensors 44 and 46 are a thermocouple, tuning fork, scale, wall pressure measure, and/or an optical sensor.

Figure 11:
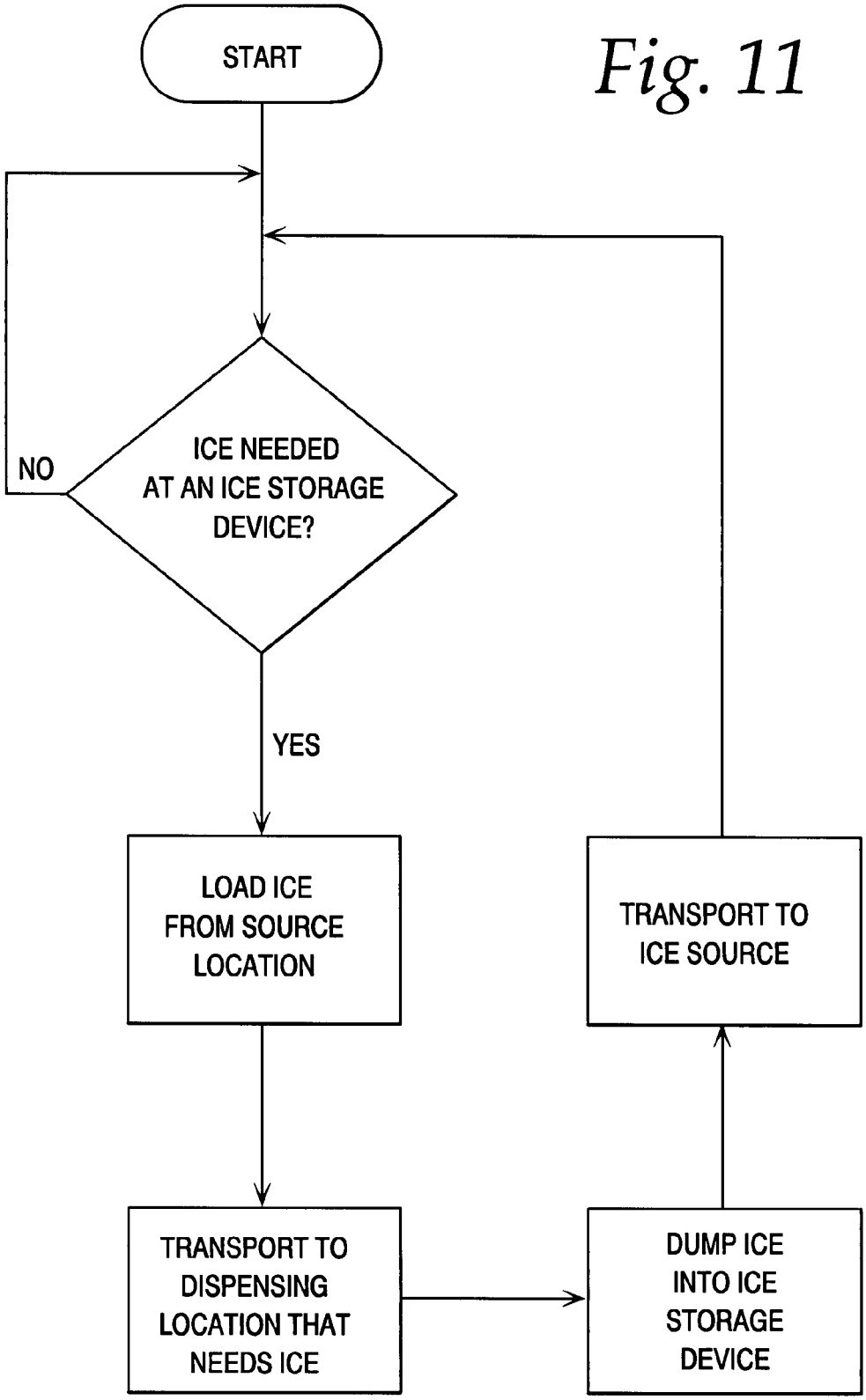
FIG. 11 is a flowchart showing operation of a system in accordance with the invention.

Referring to FIG. 11, there is illustrated an example of a control flow chart for the device 10. Controller 70 checks to determine if ice is needed at ice storage devices 40 or 42. If no ice is needed controller 70 continues to check until ice is needed at an ice storage device. The checking may be done continuously or intermittently, such as every 10 seconds. If ice is needed at an ice storage device, ice is loaded into container 14 or 16 from ice source 12 as previously described. Container 14 or 16 is then transported to its respective ice dispensing location 32 or 34. Ice I is then dumped into the respective ice storage device that is in need of ice. Next, container 14 or 16 returns to ice source 12, ready for further delivery of ice as required. Controller 70 continues to check to determine if ice is needed.

While the invention has been described with respect to certain preferred embodiments and, as will be appreciated by those skilled in the art, it is to be understood that the invention is capable of numerous changes, modifications and rearrangements and such changes, modifications and rearrangements are intended to be covered by the following claims.

The invention claimed is:

1. An automated ice transport device, comprising:

a movable container for containing ice and adapted to be mechanically transported;

a mechanical transport for mechanically transporting the container to and from a source of ice and an ice storage device at a location remote from the ice source, the mechanical transport including a pathway structure defining a pathway along which the container is mechanically transportable, the pathway extending from an ice loading location proximate the source of ice to a remote ice discharge location proximate to the ice storage device, the container attached to the pathway for transport of the container along the pathway so that the container is transportable between the ice loading location proximate the source of ice for loading ice into the container to the ice discharge location proximate the ice storage device for the discharging of ice from the container into the ice storage device;

a mounting mechanism for attaching the container to the pathway structure wherein the mechanical transporting of the mounting mechanism by the mechanical transport back and forth between the ice loading location and the ice discharge location mechanically transports the attached container along the pathway to and from the ice loading location and the ice discharge location;

means for dispensing ice from the ice source into the container attached to the pathway structure; and means for automatically discharging ice from the transported container and into the ice storage device when the container is attached to the pathway structure wherein the means for automatically discharging ice from the container comprises a container lid mounted to the container for pivotable movement between open and closed positions wherein the lid is automatically movable from the closed to open position to allow ice to be discharged from the container into the ice storage device, and at least a first trip mechanism for opening the container lid to permit discharge of the ice contained in the transportable container into the ice storage device, the first trip mechanism positioned proximate the pathway at the ice discharge location and the first trip mechanism being configured to be engaged by the container when the container is transported along the pathway by the mechanical transport to the ice discharge location to move the container lid from the closed position to the open position at the ice discharge location.

2. The device of claim 1 wherein the mechanical transport comprises a driven cable and the pathway structure comprises the cable to define the pathway along which the container is mechanically transported, and the mounting mechanism is fixedly attached to the cable whereby movement of the cable causes the container to travel along the pathway to and from the ice loading location to the ice discharge location.

3. The device of claim 1 wherein the mechanical transport comprises a driven chain and the pathway structure comprises the chain, the chain defining the pathway along which the container is mechanically transported, and the mounting mechanism is attached to the chain whereby movement of the chain causes the container to travel along the pathway to and from the ice loading location to the ice discharge location.

4. The device of claim 1 wherein the mechanical transport is mechanically moved to move the container along the pathway, the pathway structure having an outer surface and the mounting mechanism is attached to the outer surface of the pathway structure.

5. The device of claim 1 wherein the mounting mechanism includes a guide attached to the pathway structure and the mechanical transport comprises a motorized self-propelled truck carrying the guide and the attached container along the pathway along which the container travels.

6. The device of claim 1 wherein the means for dispensing ice from the ice source comprises a gravity fed discharge from the source of ice.

7. The device of claim 1 wherein the means for dispensing ice from the ice source to the container comprises a chute communicating with the ice source and the movable container when the movable container is at the loading location.

8. The device of claim 1 wherein the means for dispensing ice from the ice source to the container comprises an auger associated with the ice source for moving ice out from the ice source to the movable container when the movable container is located at the loading location.

9. The device of claim 1 wherein the means for dispensing ice from the ice source to the movable container comprises a conveyor.

10. The device of claim 1 wherein the container lid automatically closes when the container moves away from the first trip mechanism.

11. The device of claim 10 further comprising the container lid is spring biased to urge the lid to the closed position, the container having a first end and a second end, the container attached to the pathway structure being mechanically transportable along the pathway in a first direction wherein the first end is the leading end and also being transportable in a second direction wherein the second end is the leading end;

a second trip mechanism located at a fixed position along the pathway proximate to the ice loading location;

the container being mechanically transportable along the pathway in the first direction to engage the lid with the first trip mechanism to thereby open the lid; and the container mechanically transportable in the second direction to engage the lid with the second trip mechanism to thereby open the lid.

12. The device of claim 1 wherein the ice source comprises an ice maker.

13. The device of claim 11 further comprising an opening at the first end of the container, the lid positioned for closing the opening when the lid is in the closed position, the container being transportable in the first direction for the engagement of the lid with the first trip mechanism to open the lid and to position the opening of the container generally downwardly to allow ice in the container to be discharged from the container and into the ice storage device, the attached container being transportable in the second direction for engagement of the lid with the second trip mechanism to open the lid and to face the opening of the container generally upwardly to allow ice to be dispensed into the container at the ice loading location, the container being removably attached to the mechanical transport.

14. The device of claim 1 further comprising an electronic control system for controlling the operation of the automated ice transport device.

15. The device of claim 1 further comprising an ice level sensing device to determine the amount of ice present in the container at the loading location.

16. The device of claim 1 further comprising an ice level sensing device to determine the amount of ice present in the ice storage device.

17. The device of claim 15 wherein the ice level sensing device is selected from the group consisting of an optical sensor, a thermocouple sensor, a tuning fork sensor and a load sensor.

18. A method of transporting ice with an automated ice delivery system, comprising:

providing a pathway structure defining a transport pathway extending from a loading location proximate to a source of ice and a delivery location proximate to an ice storage device located remote from the loading location;

providing a container having a container lid mounted to the container for pivotable movement between open and closed positions wherein the lid is automatically movable from the closed to open position to allow ice to be discharged from the container;

providing at least a first trip mechanism for opening the container lid to permit discharge of the ice contained in the container into an ice storage device at the delivery location, the first trip mechanism positioned proximate the pathway at the delivery location whereby the first trip mechanism being configured to be engaged by the container when the container is transported along the pathway to the ice discharge location to move the container lid from the closed position to the open position at the delivery location;

providing a mounting mechanism for attaching the container to the pathway structure;

attaching the container to the pathway structure with the mounting mechanism for mechanical movement along the transport pathway;

loading ice from the source of ice into the container attached to the pathway structure at the loading location;

mechanically transporting the container attached to the pathway structure and having the ice therein along the transport pathway extending from the loading location to a delivery location remote from the loading location; and automatically discharging the ice from the container attached to the pathway structure by transporting the container for engagement of the first trip mechanism to move the container lid from the closed to open position at the delivery location to discharge the ice into the ice storage device.

19. The method of claim 18 further comprising mechanically transporting the mounting mechanism along the transport pathway to carry the attached container along the transport pathway from the ice storage location to the loading location after said discharging.

20. The method of claim 18 wherein the container has an open end and the lid is pivotably movable from the closed position for closing the open end to contain ice and to the open position for allowing ice to be dispensed into the container and for allowing ice to be discharged from the container;

providing a second trip mechanism positioned proximate to the source of ice;

mechanically transporting the container with the lid end of the container as the trailing end into a position at the loading location with the open end of the container facing in a generally upward direction wherein the transport of the container causes engagement with the second trip mechanism to open the lid for dispensing ice into the container attached to the pathway structure;

transporting the attached container containing ice from the loading location to the delivery location wherein the transport of the container with the lid end of the container as the leading end engages the first trip mechanism to open the container with the container opening facing in a generally downward direction to allow the contained ice to be discharged from the container and into the ice storage device;

sensing the amount of ice present at the ice storage location and when the amount of ice sensed is less than a predetermined amount, thereafter automatically causing the ice delivery system to operate to deposit ice into the ice storage device from the source of ice.

* * * * *